US011112744B2

(12) United States Patent
Sato et al.

(10) Patent No.: US 11,112,744 B2
(45) Date of Patent: Sep. 7, 2021

(54) POST-PROCESSING DEVICE AND IMAGE FORMING APPARATUS

(71) Applicant: FUJIFILM BUSINESS INNOVATION CORP., Tokyo (JP)

(72) Inventors: Ryuichi Sato, Kanagawa (JP); Tatsuro Matsuoka, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/837,359

(22) Filed: Apr. 1, 2020

(65) Prior Publication Data

US 2021/0088956 A1 Mar. 25, 2021

(30) Foreign Application Priority Data

Sep. 20, 2019 (JP) ..... JP2019-171671

(51) Int. Cl.
*G03G 15/00* (2006.01)
*B65H 37/04* (2006.01)

(52) U.S. Cl.
CPC ..... *G03G 15/6544* (2013.01); *B65H 37/04* (2013.01)

(58) Field of Classification Search
CPC ..... G03G 15/6544; B65H 2408/123; B65H 2601/3222; B65H 2601/322
See application file for complete search history.

(56) References Cited

U.S. PATENT DOCUMENTS 6,092,712 A * 7/2000 Rueckl ..... B42B 4/00 227/110
2003/0044209 A1* 3/2003 Isobe ..... G03G 15/6541 399/410

FOREIGN PATENT DOCUMENTS

JP H2-279388 A 11/1990
JP H11-301918 A 11/1999
JP 2013-95555 A 5/2013

* cited by examiner

*Primary Examiner* — Jennifer Bahls
(74) *Attorney, Agent, or Firm* — Oliff PLC

(57) ABSTRACT

A post-processing device including a stapler includes a restraint mechanism that restrains the stapler so that the stapler does not deviate from an initial position when a covering part is opened and a restraint release mechanism that, when the covering part is closed, releases restraint of the stapler by the restraint mechanism.

20 Claims, 8 Drawing Sheets

POST-PROCESSING DEVICE AND IMAGE FORMING APPARATUS

CROSS-REFERENCE TO RELATED APPLICATIONS

This application is based on and claims priority under 35 USC 119 from Japanese Patent Application No. 2019-171671 filed Sep. 20, 2019.

BACKGROUND

(i) Technical Field

The present disclosure relates to a post-processing device and an image forming apparatus.

(ii) Related Art

Post-processing devices that align, stack, and staple plural sheets of recording paper have been known (for example, refer to Japanese Unexamined Patent Application Publication No. 2013-95555). In such a post-processing device, a stapler is movable from the deeper side to the front side of the body of the post-processing device, and stapling is enabled to be performed at multiple positions.

SUMMARY

Aspects of non-limiting embodiments of the present disclosure relate to a post-processing device that enables a stapler not to deviate from an initial position at the time a printing job starts even if a user opens a covering part and touches the stapler.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a post-processing device including a stapler. The post-processing device includes a restraint mechanism that restrains the stapler so that the stapler does not deviate from an initial position when a covering part is opened and a restraint release mechanism that, when the covering part is closed, releases restraint of the stapler by the restraint mechanism.

BRIEF DESCRIPTION OF THE DRAWINGS

An exemplary embodiment of the present disclosure will be described in detail based on the following figures, wherein.

DETAILED DESCRIPTION

Figure 1:
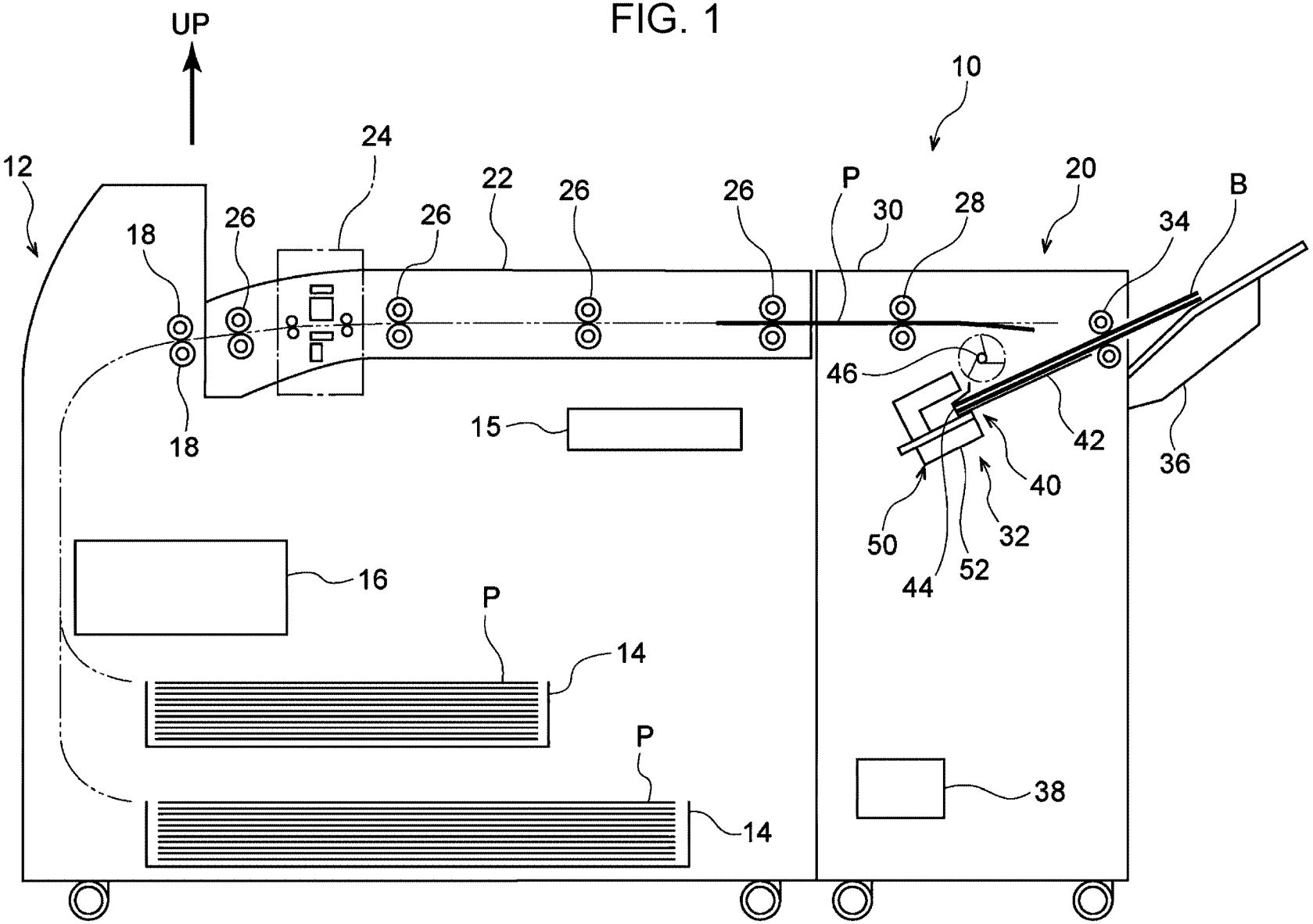
FIG. 1 illustrates an outline configuration of an image forming apparatus including a post-processing device according to the present exemplary embodiment.

Hereinafter, an exemplary embodiment according to the present disclosure will be described in detail based on the figures. In the following description, the upstream side of the transport direction of recording paper P, which is an example of a recording medium, is sometimes simply referred to as the "upstream side", and the downstream side of the transport direction is sometimes simply referred to as the "downstream side". Arrow UP in FIG. 1 denotes the upward direction of an image forming apparatus 10, the front side of FIG. 1 is referred to as the "front side", and the deeper side of FIG. 1 is referred to as the "back side". The front-back direction of the image forming apparatus 10 is sometimes referred to as the "width direction".

As illustrated in FIG. 1, the image forming apparatus 10 includes an image forming apparatus body 12 that forms an image on the recording paper P and a post-processing device 20 that performs post processing such as binding (stapling) plural sheets of recording paper P on which images have been formed by the image forming apparatus body 12.

Image Forming Apparatus Body

The image forming apparatus body 12 includes storing portions 14 that store the recording paper P, an image forming unit 16 that forms an image on the recording paper P, a discharging roller 18 that discharges the recording paper P on which the image has been formed, and a controller 15 that controls operations of the image forming apparatus body 12.

The plural storing portions 14 are provided so as to enable storing sheets of recording paper P in different sizes or types. In addition, each storing portion 14 is extractable toward the front side to enable a supplying operation of sheets of recording paper P to be performed with the storing portion 14 extracted.

The image forming unit 16 forms an image on the recording paper P that has been transported from the storing portions 14. The image forming unit 16 may employ an electrophotographic system in which an image is formed by transferring a toner image stuck to a photoreceptor onto the recording paper P or an inkjet system in which an image is formed by ejecting ink onto the recording paper P.

The discharging roller 18 discharges the recording paper P on which the image has been formed by the image forming unit 16. The discharging roller 18 is constituted by a pair of rollers that sends out the recording paper P while holding the recording paper P therebetween. The pair of rollers discharges the recording paper P from the image forming apparatus body 12 by rotating in respective directions that are opposite to each other.

The controller 15 controls an operation of each constituent member provided in the image forming apparatus body 12. In addition, with respect to the post-processing device 20, the controller 15 outputs an instruction signal indicating that post processing of the recording paper P is to be performed.

Here, the operation of the image forming apparatus body 12 will be briefly described. Frist, sheets of recording paper P are sent out one by one from a corresponding one of the storing portions 14 in response to instruction signals outputted from the controller 15. After an image is formed by the image forming unit 16 on the recording paper P that has been sent out from the storing portion 14, the recording paper P is discharged through the discharging roller 18.

Post-Processing Device

The post-processing device 20 includes a transport unit 22 that is connected on the downstream side of the discharging roller 18 of the image forming apparatus body 12 and also includes a finisher unit 30 that performs predetermined post processing with respect to the recording paper P that has been transported by the transport unit 22.

The transport unit 22 includes plural transport rollers 26 that transport the recording paper P on which an image has been formed in the image forming apparatus body 12 toward the finisher unit 30 and also includes a punch mechanism 24 that makes holes (punching), for example, two holes or four holes in the recording paper P.

The finisher unit 30 includes a binding section 32 that binds a paper bundle B, a transport roller 28 that transports the recording paper P toward the binding section 32, a discharging roller 34 that discharges the paper bundle B that has been bound by the binding section 32, a stacking portion 36 that is to be stacked with the discharged paper bundle B, and a controller 38 that controls the operation of each constituent member provided in the post-processing device 20.

Here, the operation of the post-processing device 20 will be briefly described. First, an instruction signal is outputted from the controller 15 of the image forming apparatus body 12 to the controller 38 of the post-processing device 20. The instruction signal indicates that post processing of the recording paper P is to be performed. Responding to the instruction signal, the controller 38 outputs an instruction signal to each constituent member of the post-processing device 20. The instruction signal allows each constituent member of the post-processing device 20 to perform post processing of the recording paper P.

Alongside the above operation, the recording paper P on which the image has been formed in the image forming apparatus body 12 is supplied to the transport unit 22 of the post-processing device 20. In the transport unit 22, the punch mechanism 24 makes holes (punching) as needed, and the recording paper P is then transported to the finisher unit 30 by the transport rollers 26.

The recording paper P that has been supplied to the finisher unit 30 is further transported by the transport roller 28 and is bound by the binding section 32. The paper bundle B that has been bound by the binding section 32 is discharged onto the stacking portion 36 by the discharging roller 34.

Binding Section

As illustrated in FIG. 1, the binding section 32 collects sheets of recording paper P and forms a paper bundle B and binds the paper bundle B. In the binding section 32, binding is selectable depending on a type of printing job between staple-free binding in which the paper bundle B is bound without a staple (a piece of wire) and staple binding in which the paper bundle B is bound with a staple (a piece of wire). A location in the paper bundle B to which the binding is performed is also selectable.

Figure 2:
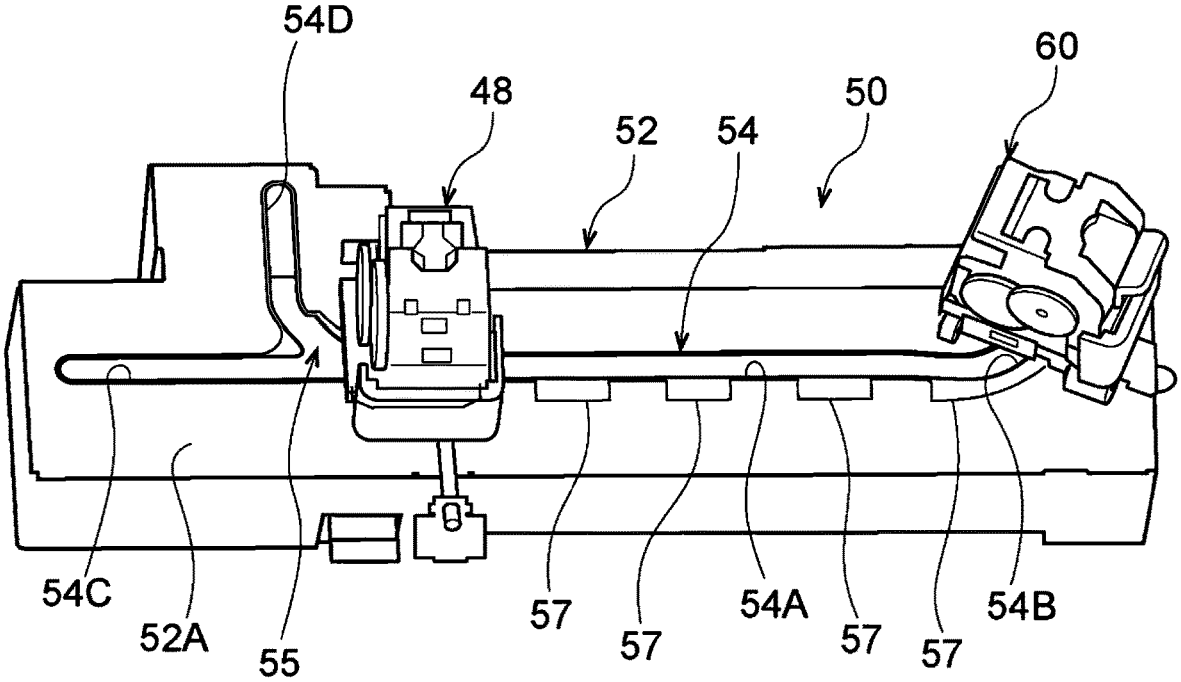
FIG. 2 is a top perspective view of staplers and a guide unit of the post-processing device according to the present exemplary embodiment.

In addition, as illustrated in FIGS. 1 and 2, the binding section 32 includes a collection portion 40 that collects the sheets of recording paper P and forms the paper bundle B, a staple-free stapler 48 that performs the staple-free binding with respect to the paper bundle B, a stapler 60 that performs the binding with staple with respect to the paper bundle B (the paper bundle B is bound with a staple), and a guide unit 50 that guides the staple-free stapler 48 and the stapler 60.

The collection portion 40 includes a collection board 42 that supports the sheets of recording paper P from below and that collects the instructed number of the sheets of recording paper P to form the paper bundle B, an abutment portion 44 that the lower ends of the sheets of recording paper P that have moved onto the collection board 42 abut, a transport paddle 46 that transports the sheets of recording paper P toward the abutment portion 44, and width-direction alignment portions (not illustrated) that align the positions in the width direction of each sheet of recording paper P that has been collected on the collection board 42.

As illustrated in FIG. 1, the collection board 42 is inclined relative to the horizontal direction. In the present exemplary embodiment, a surface on which the sheets of recording paper P are collected is inclined at 30 degrees relative to the horizontal direction. Therefore, due to such an inclination of the collection board 42, the sheets of recording paper P move downward along the collection board 42 under their own weight.

The lower ends of the sheets of recording paper P are aligned by abutting the abutment portion 44. The width-direction alignment portions are provided on both sides in the width direction with the collection board 42 interposed therebetween and move in the width direction in response to being driven by a driving source (not illustrated). Therefore, the positions in the width direction of the sheets of recording paper P that have abutted the abutment portion 44 are aligned.

The transport paddle 46 is disposed above the collection board 42. The transport paddle 46 transports the sheets of recording paper P toward the abutment portion 44 by rotating in response to being driven by the driving source (not illustrated). The paper bundle B that has been collected and bound on the collection board 42 is discharged by the discharging roller 34 in a direction away from the abutment portion 44 (upward direction along the collection board 42).

Figure 3:
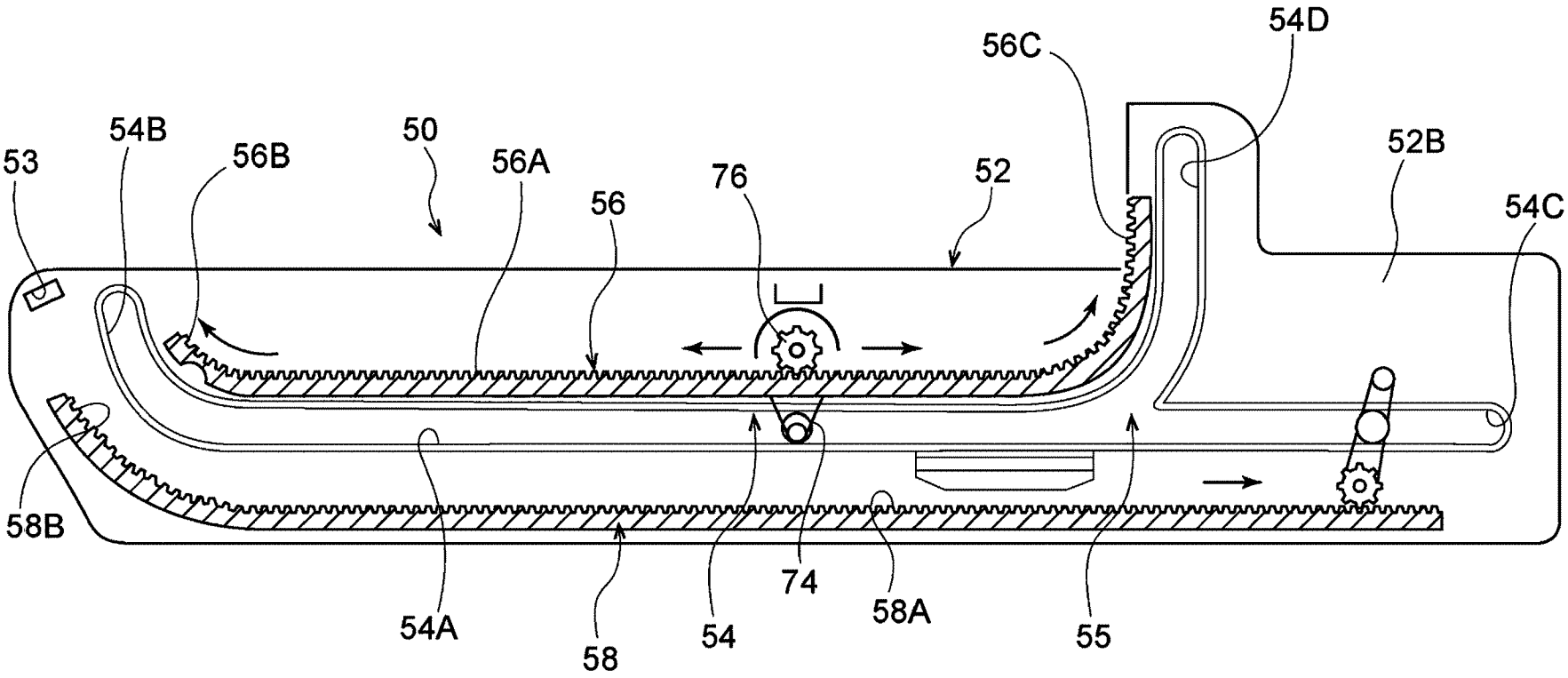
FIG. 3 is a bottom view of the guide unit of the post-processing device according to the present exemplary embodiment.

As illustrated in FIGS. 2 and 3, the guide unit 50 includes a support board 52 that supports the staple-free stapler 48 and the stapler 60, and a guide groove 54 that guides the staple-free stapler 48 and the stapler 60 in predetermined directions. The guide unit 50 includes a staple-free stapler rack 58 that is a rack gear provided along a movement path of the staple-free stapler 48 and a stapler rack 56 that is a rack gear provided along a movement path of the stapler 60.

The support board 52 is a substantially rectangular and board-shaped member in which the longitudinal direction thereof corresponds to the width direction. The support board 52 has an upper surface 52A facing upward and a lower surface 52B facing downward. The support board 52 is disposed on the lower side of the collection board 42 and extends along the collection board 42. That is, the support board 52 is inclined relative to the horizontal direction, as with the collection board 42. In the present exemplary embodiment, at least the upper surface 52A of the support board 52 is inclined at 30 degrees relative to the horizontal direction (refer to FIG. 1).

Due to such an inclination of the support board 52, the staple-free stapler 48 and the stapler 60 that are supported by the support board 52 are also disposed to be inclined. That is, the staple-free stapler 48 and the stapler 60 are disposed at an angle equal to the angle at which the collection board 42 (the support board 52) is inclined.

The guide groove 54 is an elongated opening that extends through in the thickness direction of the support board 52. The guide groove 54 has a linear groove portion 54A that extends in the width direction, in which the staple-free stapler 48 and the stapler 60 move, and that is common to both staplers. The guide groove 54 has a curved groove portion 54B that is on the front side of the linear groove portion 54A and that extends to curve toward the upper side, a branch point 55 positioned on the back side of the linear groove portion 54A, and a staple-free stapler groove portion 54C and a stapler groove portion 54D that are continuous from and branch off from the linear groove portion 54A via the branch point 55.

The linear groove portion 54A, the curved groove portion 54B, the staple-free stapler groove portion 54C, and the stapler groove portion 54D have the same groove width. In the upper surface 52A of the support board 52, thin plate-shaped guide walls 57 are disposed on lower-side edge portions of the linear groove portion 54A and the curved groove portion 54B (also refer to FIG. 5). The guide walls 57 are formed integrally with the edge portions.

The staple-free stapler groove portion 54C extends in the width direction so as to have a substantially linear shape. The staple-free stapler groove portion 54C continues from the linear groove portion 54A via the branch point 55 and extends in the direction of the linear groove portion 54A (the width direction). The staple-free stapler 48 enters the staple-free stapler groove portion 54C, whereas the stapler 60 does not enter the staple-free stapler groove portion 54C.

The stapler groove portion 54D continues from the linear groove portion 54A via the branch point 55 and extends to curve upward from the branch point 55. The stapler 60 enters the stapler groove portion 54D, whereas the staple-free stapler 48 does not enter the stapler groove portion 54D.

That is, the staple-free stapler 48 is movable along the curved groove portion 54B, the linear groove portion 54A, and the staple-free stapler groove portion 54C via the branch point 55. The stapler 60 is movable along the curved groove portion 54B, the linear groove portion 54A, and the stapler groove portion 54D via the branch point 55. Due to such switching of movement paths, the staple-free stapler 48 and the stapler 60 are able to be guided to respective predetermined withdrawal positions individually.

That is, when the staple-free stapler 48 performs binding, the stapler 60 is withdrawn to the stapler groove portion 54D. When the stapler 60 performs binding, the staple-free stapler 48 is withdrawn to the staple-free stapler groove portion 54C. Therefore, the staple-free stapler 48 does not interfere with the binding by the stapler 60, and vice-versa.

As illustrated in FIG. 3, on the lower surface 52B side of the support board 52, the staple-free stapler rack 58 extends along the curved groove portion 54B, the linear groove portion 54A, and the staple-free stapler groove portion 54C. The staple-free stapler rack 58 has a staple-free stapler-rack linear portion 58A that has a substantially linear shape in which the longitudinal direction extends in the width direction. The staple-free stapler rack 58 also has a staple-free stapler-rack curved portion 58B that extends to curve from a front-side end portion of the staple-free stapler-rack linear portion 58A along the curved groove portion 54B. A toothed surface is provided on one side of the staple-free stapler rack 58, the side facing upward.

On the lower surface 52B side of the support board 52, the stapler rack 56 is provided along the curved groove portion 54B, the linear groove portion 54A, and the stapler groove portion 54D. The stapler rack 56 has a stapler-rack linear portion 56A that has a substantially linear shape in which the longitudinal direction extends in the width direction, a stapler-rack curved portion 56B that extends to curve from a front-side end portion of the stapler-rack linear portion 56A along the curved groove portion 54B, and a stapler-rack curved portion 56C that extends to curve from a back-side end portion of the stapler-rack linear portion 56A along the stapler groove portion 54D.

The stapler rack 56 is disposed on the upper side of the linear groove portion 54A and on the front side of the stapler groove portion 54D. That is, the stapler rack 56 is provided at a position opposite the staple-free stapler rack 58 with the linear groove portion 54A, the staple-free stapler groove portion 54C, and the stapler groove portion 54D interposed therebetween. A toothed surface is provided on one side of the stapler rack 56, the side facing upward.

As described above, the guide groove 54, the staple-free stapler rack 58, and the stapler rack 56 extend to the front side of the support board 52. Therefore, the staple-free stapler 48 and the stapler 60 that are movable along the guide groove 54 are enabled to approach a user at a position on the front side of the image forming apparatus body 12.

In other words, it is possible for the user to operate (access) the staple-free stapler 48 and the stapler 60 from the front side of the image forming apparatus body 12. Consequently, operations that are performed by the user and that are relevant to the staple-free stapler 48, such as maintenance inspections of the staple-free stapler 48 are enabled to be easily performed. In addition, operations that are performed by the user and that are relevant to the stapler 60, such as supplying staples (pieces of wire) are enabled to be easily performed.

In the present exemplary embodiment, the staple-free stapler 48 is moved to a position in the staple-free stapler groove portion 54C, the position being a home position (initial position) of the staple-free stapler 48. The stapler 60 is moved to a position in the curved groove portion 54B, the position being a home position (initial position) of the stapler 60. That is, the staple-free stapler 48 and the stapler 60 differ in terms of home position. The stapler 60 is supplied with staples at the home position.

Next, the stapler 60 and a restraint mechanism 80 and a restraint release mechanism 90 of the stapler 60 will be described.

Figure 4:
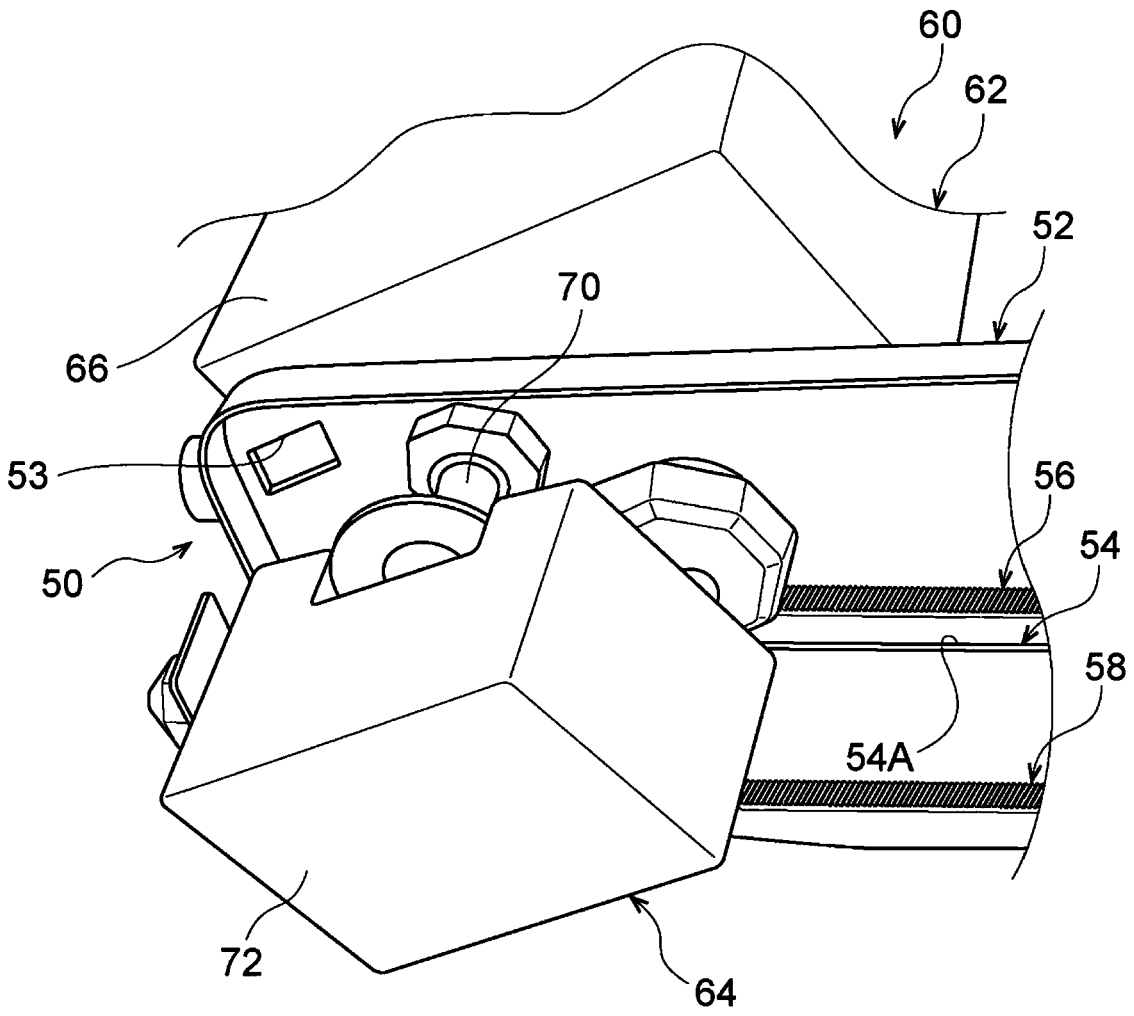
FIG. 4 is a bottom perspective view of the stapler and the guide unit of the post-processing device according to the present exemplary embodiment.
Figure 5:
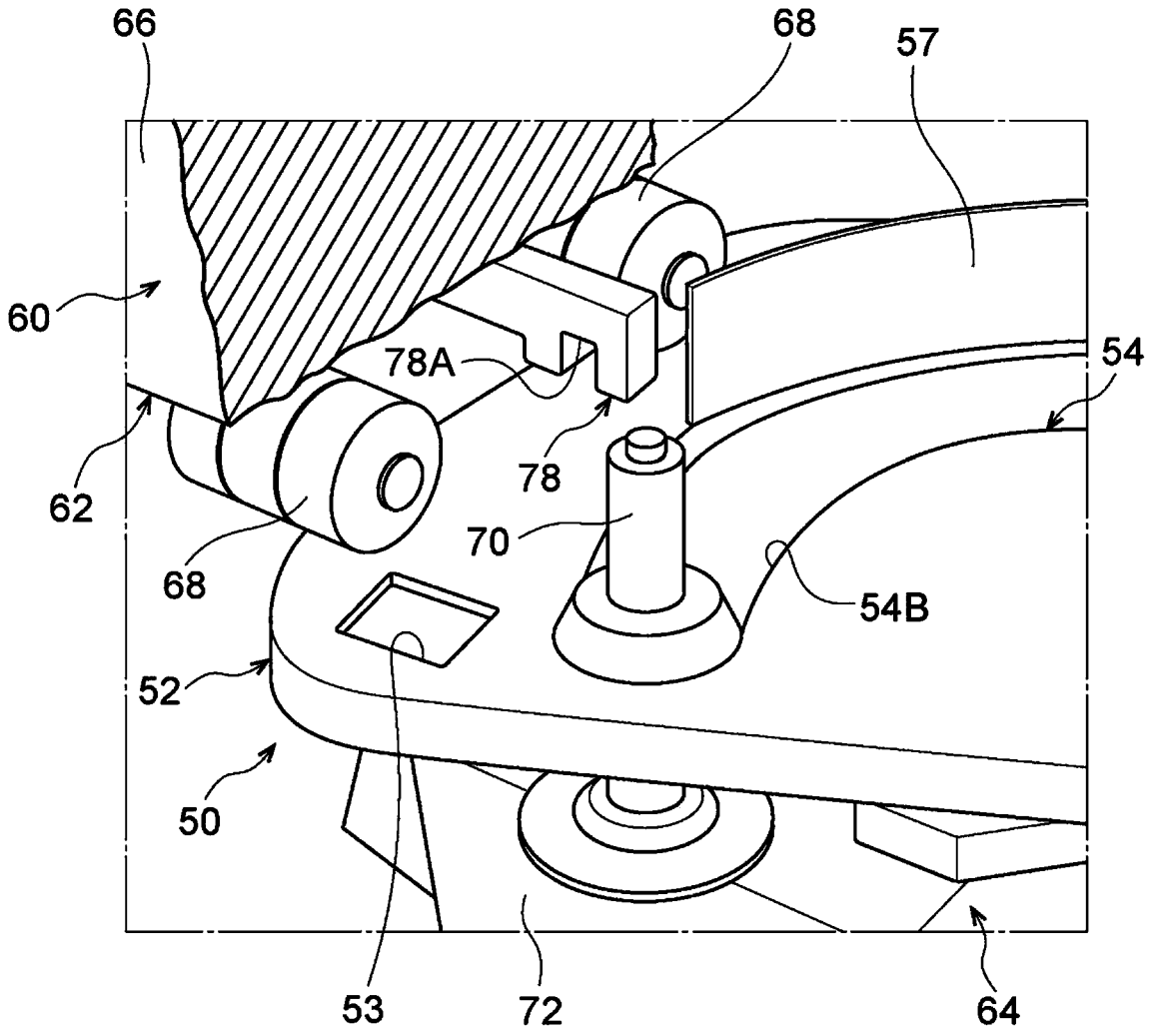
FIG. 5 is an enlarged perspective view of the stapler and the guide unit of the post-processing device according to the present exemplary embodiment as viewed from the top with a portion of the stapler cut away.

As illustrated in FIGS. 4 and 5, the stapler 60 includes an upper unit 62 positioned on the upper surface 52A side of the support board 52 and a lower unit 64 positioned on the lower surface 52B side of the support board 52. The upper unit 62 includes a stapler body 66 that attaches staples (pieces of wire) to sheets of recording paper P and wheels 68 that move on the upper surface 52A of the support board 52 while rotating.

The lower unit 64 includes a motor 72 that is a driving source, a timing belt 74 (refer to FIG. 3) that rotates in response to being driven by the motor 72, a pinion gear 76 (refer to FIG. 3) that rotates in response to being driven by the motor 72 via the timing belt 74 and that engages the toothed surface of the stapler rack 56. A movable roller 70 passing through the guide groove 54 connects the upper unit 62 and the lower unit 64.

As illustrated in FIG. 5, each wheel 68 is a substantially columnar-shaped member and is capable of rotating. On the upper surface 52A, two wheels 68 are provided on the lower side of the linear groove portion 54A, and two wheels 68 are provided on the upper side of the linear groove portion 54A. A sensor member 78 is provided between the two wheels 68 on the lower side and protrudes upward. In an end portion of the sensor member 78, a recess 78A into which the guide walls 57 are inserted is formed.

When the stapler 60 is at the home position, the sensor member 78 is detached from the guide walls 57. In other words, the sensor member 78 detects that the stapler 60 is at the home position by being moved toward the front side and being detached from the guide walls 57.

Figure 6:
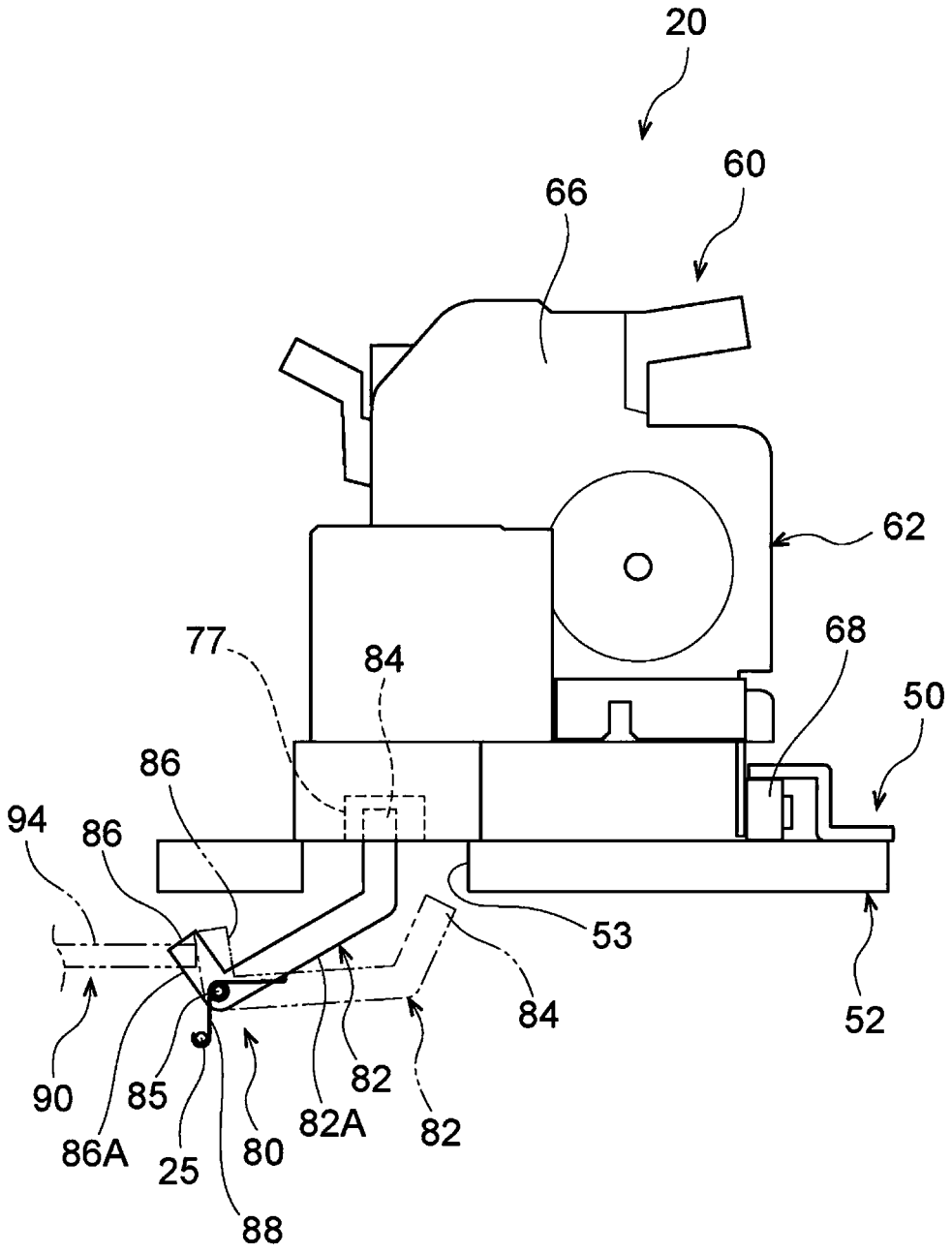
FIG. 6 is a side view of a restraint mechanism and a restraint release mechanism for the stapler of the post-processing device according to the present exemplary embodiment.

As illustrated in FIGS. 3 to 5, a rectangular opening 53 is formed in a front end portion of the support board 52. An engaging portion 84 of a restraint member 82, which will be described later, passes through the opening 53. As illustrated in FIG. 6, between the two wheels 68 disposed on the lower side (and next to the sensor member 78), a recess 77, as an example of an engaged portion into which the engaging portion 84 passing through the opening 53 is inserted, is formed.

As illustrated in FIG. 6, the post-processing device 20 includes the restraint mechanism 80 and the restraint release mechanism 90. When a covering part 92 (refer to FIG. 7) is opened, the restraint mechanism 80 restrains the stapler 60 (limits the amount of movement of the stapler 60) so that the stapler 60 does not deviate from the home position along the guide groove 54. When the covering part 92 is closed, the restraint release mechanism 90 releases the restraint of the stapler 60 by the restraint mechanism 80.

To be more specific, the restraint mechanism 80 includes the restraint member 82 and a torsion spring 88. The restraint member 82 includes the engaging portion 84 that is inserted into the recess 77 provided in the stapler 60 and that engages the recess 77. The torsion spring 88, as an example of an urging member, urges the engaging portion 84 in the direction in which the engaging portion 84 is inserted into the recess 77.

In a side view of FIG. 6, the restraint member 82 has a substantially U shape in which the engaging portion 84 that protrudes upward is formed in one end portion thereof, and a base portion 86 that protrudes upward and that is shorter than the engaging portion 84 is formed in the other end portion thereof. A support shaft 85 passes through a proximal end of the base portion 86. That is, the restraint member 82 is capable of rotating around the support shaft 85.

A coil portion of the torsion spring 88 is fitted onto the support shaft 85. One end portion of the torsion spring 88 engages a hook portion 25 provided in the post-processing device 20. The other end portion of the torsion spring 88 engages an end face 82A on the lower side of the restraint member 82.

Therefore, the engaging portion 84 is urged in the direction in which the engaging portion 84 is inserted into the recess 77 by the urging force exerted by the torsion spring 88 (the upward direction). That is, the engaging portion 84 engages the recess 77 (is inserted into the recess 77) by protruding from the lower side in the vertical direction (not a lower side in the actual vertical direction but a lower side in a direction slightly inclined relative to the vertical direction).

Figure 8A:
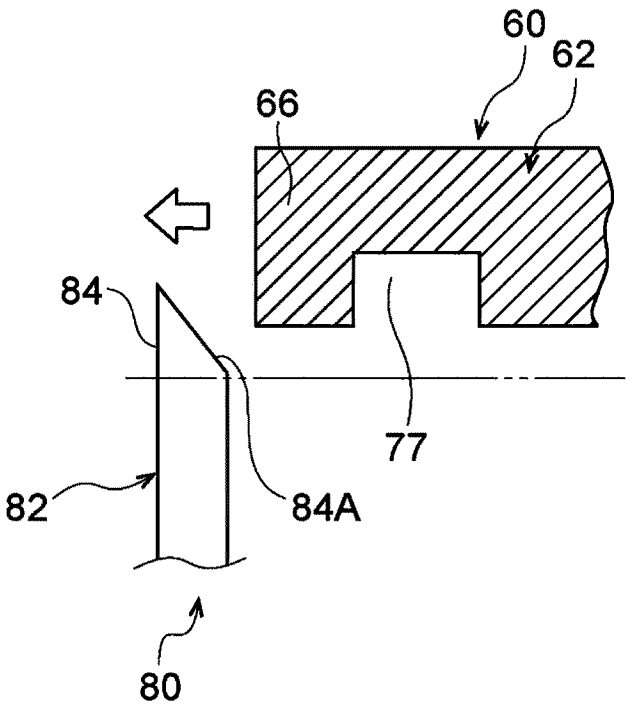
FIGS. 8A, 8B, and 8C illustrate a manual operation of the restraint mechanism for the stapler of the post-processing device according to the present exemplary embodiment.
Figure 8B:
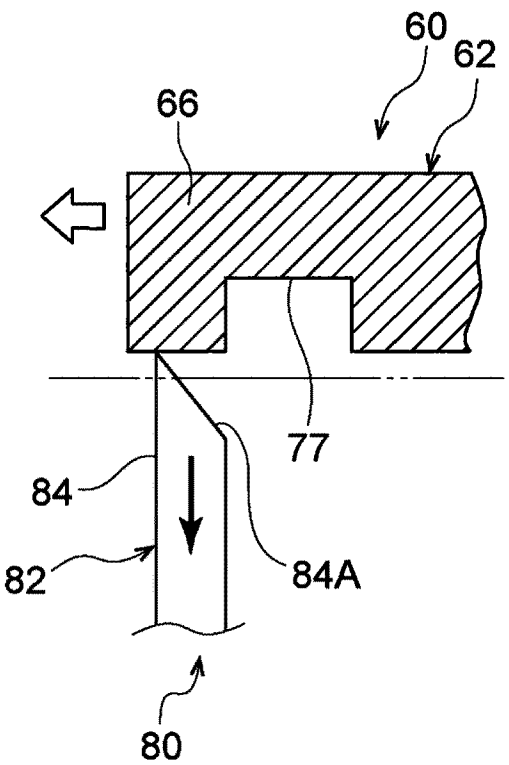
Figure 8C:
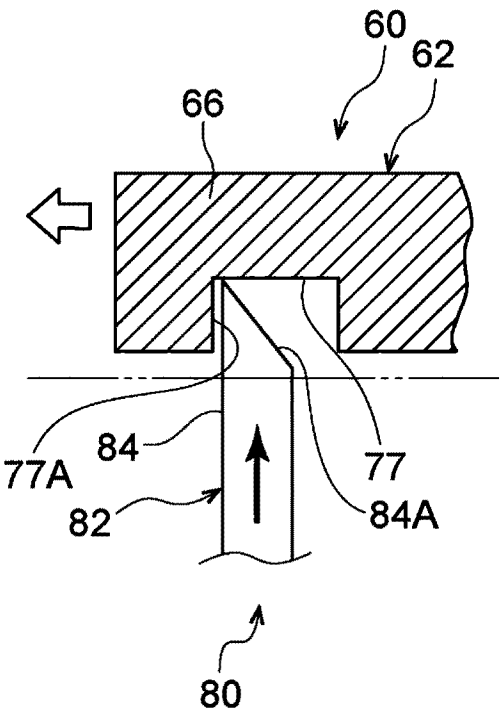

As illustrated in FIGS. 8A, 8B, and 8C, in the engaging portion 84, an end face that faces the upstream side in a movement direction in which the stapler 60 moves to the home position is a tapered face 84A that is inclined relative to the movement direction of the stapler 60 and the substantially up-down direction. The recess 77 has a substantially rectangular shape as viewed from the bottom.

An inner wall 77A (refer to FIG. 8C) of the recess 77 on a side toward which the stapler 60 moves to the home position comes into contact with a face of the engaging portion 84 opposite to the tapered face 84A (the position thereof is regulated), and the stapler 60 is thereby suppressed from deviating from the home position (the amount of movement is limited).

As illustrated in FIG. 6, in the base portion 86 of the restraint member 82, an end face 86A that continues from the end face 82A that the other end portion of the torsion spring 88 engages is disposed toward the front side of the post-processing device 20. That is, the end face 86A of the base portion 86 is disposed, not toward the stapler 60, but toward the covering part 92 with which the front portion of the post-processing device 20 is opened or closed.

Figure 7:
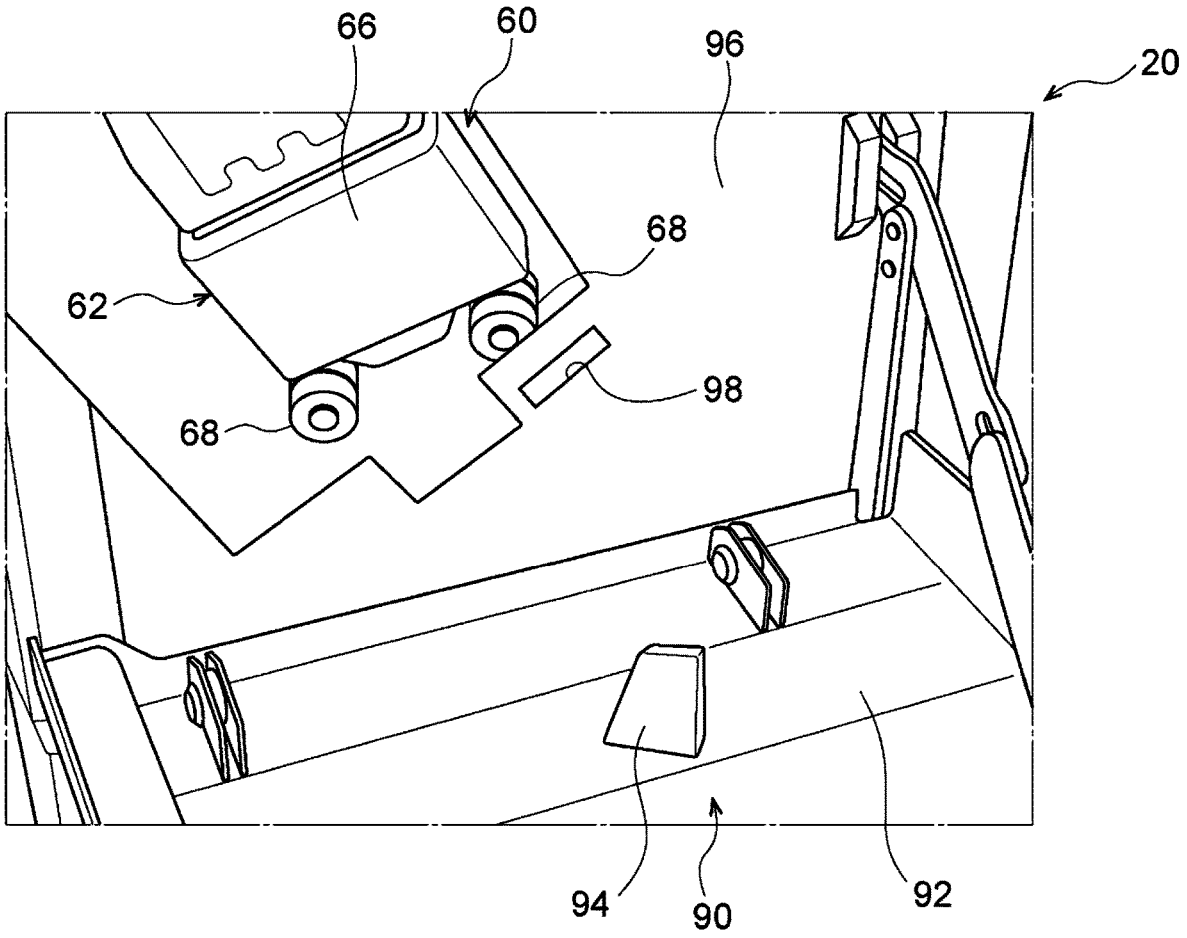
FIG. 7 is a perspective view of the post-processing device according to the present exemplary embodiment with a covering part thereof opened.

As illustrated in FIG. 7, the restraint release mechanism 90 is a substantially trapezoidal thin plate-shaped protrusion 94 that is disposed on an inner face of the covering part 92. The covering part 92 is an outer front wall of the post-processing device 20, and a lower end portion of the covering part 92 is rotatably supported by a lower end portion of an inner front wall 96 of the post-processing device 20.

The inner front wall 96 that is opposite the inner face of the covering part 92 when the covering part 92 is closed has a slit 98 into which the protrusion 94 is inserted (having a width that disables insertion of the finger of a user thereinto). The base portion 86 of the restraint member 82 is disposed inside the slit 98.

Consequently, following an action of closing the covering part 92, the protrusion 94 that is inserted into the slit 98 pushes the end face 86A of the base portion 86 of the restraint member 82 (the end face 86A at a position upper than the support shaft 85) against the urging force exerted by the torsion spring 88. Therefore, as illustrated by the imaginary lines in FIG. 6, the engaging portion 84 rotates around the support shaft 85 in a direction away from the recess 77, and the restraint of the stapler 60 is thus released.

Regarding the post-processing device 20 having the above-described configuration, the functions thereof will be described next.

In the post-processing device 20, the covering part 92 is closed when the binding section 32 performs binding. That is, the protrusion 94 that has passed through the slit 98 is pushing the base portion 86 of the restraint member 82 (the end face 86A at a position upper than the support shaft 85). Consequently, the restraint member 82 rotates around the support shaft 85 against the urging force exerted by the torsion spring 88, and the engaging portion 84 of the restraint member 82 is detached from the recess 77. Therefore, the movement of the stapler 60 is not interfered (the stapler 60 becomes movable along the guide groove 54), and the binding by the stapler 60 is performed.

Information such as the remaining amount of staples (pieces of wire) is displayed on a user interface. When a user has determined from the remaining amount that the stapler 60 is needed to be supplied with staples (pieces of wire), the user opens the covering part 92. Before the opening, the user is informed of whether the stapler 60 is at the home position by the user interface. That is, the sensor member 78 detects whether the sensor member 78 is detached from the guide walls 57, and, in a case in which the sensor member 78 detects that the sensor member 78 is detached from the guide walls 57, the stapler 60 is determined to be at the home position.

When the stapler 60 is determined to be at the home position, the covering part 92 is opened as illustrated in FIG. 7. Consequently, the protrusion 94 moves away from the base portion 86 (the end face 86A) of the restraint member 82, the restraint member 82 is rotated around the support shaft 85 by the urging force exerted by the torsion spring 88, and the engaging portion 84 of the restraint member 82 passes through the opening 53 and is inserted into the recess 77. The stapler 60 is thereby restrained, and even when the user supplies staples (pieces of wire) to the stapler 60 (even when the user touches the stapler 60), the stapler 60 does not move (the movement of the stapler 60 is suppressed or prevented).

After the stapler 60 has been supplied with staples (pieces of wire), the covering part 92 is closed. Then, the protrusion 94 passes through the slit 98 and pushes the base portion 86 of the restraint member 82 (the end face 86A at a position upper than the support shaft 85). Therefore, the restraint member 82 rotates around the support shaft 85 against the urging force exerted by the torsion spring 88, and the engaging portion 84 of the restraint member 82 is detached from the recess 77. However, the stapler 60 is at the home position.

That is, even after the user opens the covering part 92 and touches the stapler 60, at the time the printing job starts, the stapler 60 is in a state of not deviating from the home position (the sensor member 78 detects that the stapler 60 is at the home position). Consequently, an initializing operation to set the position of the stapler 60 is not needed each time the covering part 92 is opened or closed (the initializing operation of the stapler 60 may be less necessary compared with a case in which the stapler 60 is capable of moving even if the covering part 92 is opened).

Therefore, the following circumstances are also addressed. That is, the stapler 60 is a heavy component; thus, operation noise thereof is not low. In recent years, eliminating (minimizing) the initializing operation is required to meet an increasing demand for a quiet office environment. The post-processing device 20 according to the present exemplary embodiment addresses the circumstance.

Moreover, the initializing operation is not needed each time the covering part 92 is opened or closed; thus, noise generation may be reduced, power consumption may be reduced, and the life and reliability of the post-processing device 20 in itself may be increased, compared with a case in which the initializing operation is performed each time the covering part 92 is opened or closed. Furthermore, the slit 98 does not allow insertion of the finger of the user; thus, a trouble in which the user mistakenly releases the restraint of the stapler 60 does not occur.

The restraint mechanism 80 is configured of the restraint member 82 including the engaging portion 84 that engages the recess 77 provided in the stapler 60 and the torsion spring 88 that urges the engaging portion 84 toward the recess 77. Thus, the restraint mechanism 80 may be formed simply.

The restraint release mechanism 90 is the protrusion 94 provided on the inner face of the covering part 92. Consequently, the restraint release mechanism 90 may be formed simply compared with the restraint release mechanism 90 that is the protrusion 94 provided on a member different from the covering part 92.

Moreover, the base portion 86 of the restraint member 82 is disposed closer than the stapler 60 to the covering part 92; thus, the protrusion 94 is short, compared with a case in which the base portion 86 of the restraint member 82 is disposed away from the covering part 92.

The engaging portion 84 protrudes from the lower side in the vertical direction and engages the recess 77; thus, during the printing job, the movement of the stapler 60 may be suppressed or prevented from being interfered compared with a configuration in which the engaging portion 84 protrudes from the upper side in the vertical direction and engages the recess.

Furthermore, the engaging portion 84 passes through the opening 53 formed in the support board 52 and engages the recess 77; thus, the restraint mechanism 80 may be formed to be compact, compared with a configuration in which, for example, the engaging portion 84 passes outside the support board 52 and engages the recess 77.

If the covering part 92 needs to be opened in a state in which the stapler 60 is not at the home position (a state in which it is detected that the sensor member 78 is not detached from the guide walls 57) due to occurrence of a jam of a sheet of recording paper P, a jam of a staple, or the like, the stapler 60 is manually moved to the home position before the printing job starts.

That is, as illustrated in FIG. 8A, the user moves the stapler 60 to the home position by holding the stapler 60 with the fingers. Here, as described above, in the engaging portion 84, the end face that faces the upstream side in the movement direction in which the stapler 60 moves to the home position is the tapered face 84A.

Consequently, as illustrated in FIGS. 8B and 8C, following the movement of the stapler 60, even if peripheral portions constituting the recess 77 of the stapler 60 abut the tapered face 84A of the engaging portion 84, it is possible for the peripheral portions to easily climb over the engaging portion 84 by moving along the tapered face 84A (by such one action without any other actions).

That is, it is possible to cause the restraint member 82 to rotate against the urging force exerted by the torsion spring 88 and to cause the engaging portion 84 to move downward. Moreover, it is possible to cause the restraint member 82 to rotate at the time of arrival of the engaging portion 84 at the recess 77 due to the urging force exerted by the torsion spring 88 and to cause the engaging portion 84 to be inserted into the recess 77 (restraint may be enabled in a smooth manner).

Therefore, even in this case, at the time the printing job starts, the stapler 60 is in the state of not deviating from the home position (the sensor member 78 detects that the stapler 60 is at the home position); thus, the initializing operation to set the position of the stapler 60 is not needed.

The post-processing device 20 and the image forming apparatus 10 according to the present exemplary embodiment are described with reference to the figures as above. However, the post-processing device 20 and the image forming apparatus 10 according to the present exemplary embodiment are not limited to the illustrated post-processing device 20 and the illustrated image forming apparatus 10 and may be modified as appropriate without departing from the spirit of the present disclosure.

For example, the restraint mechanism 80 is not limited to the illustrated restraint member 82 and the torsion spring 88 and may be formed by appropriately using a component such as an existing component provided in the post-processing device 20. Similarly, the restraint release mechanism 90 is not limited to the illustrated protrusion 94 disposed on the inner face of the covering part 92 and may be formed by appropriately using a component such as an existing component provided in the post-processing device 20.

In addition, the engaging portion 84 is not limited to a configuration in which the engaging portion 84 engages the recess 77 by protruding from the lower side in the vertical direction. For example, according to the position of the recess 77, the engaging portion 84 may engage the recess 77 by protruding in the horizontal direction. In addition, as an alternative to the tapered face 84A formed in the engaging portion 84, a tapered face (not illustrated) or the like that guides the engaging portion 84 to the recess 77 may be formed in the peripheral portions that constitute the recess 77 of the stapler 60 and that the engaging portion 84 abut when the stapler 60 is moved manually.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A post-processing device including a stapler, the post-processing device comprising:

a restraint mechanism that restrains the stapler so that the stapler does not deviate from an initial position when a covering part is opened; and a restraint release mechanism that, when the covering part is closed, releases restraint of the stapler by the restraint mechanism.

2. The post-processing device according to claim 1, wherein the restraint mechanism includes a restraint member including an engaging portion that engages an engaged portion provided in the stapler, and an urging member that urges the engaging portion toward the engaged portion.

3. The post-processing device according to claim 2, wherein the engaging portion has an end face that faces an upstream side in a movement direction in which the stapler moves to the initial position, the end face being tapered.

4. The post-processing device according to claim 3, wherein the engaging portion engages the engaged portion by protruding from a lower side in a vertical direction.

5. The post-processing device according to claim 4, wherein the stapler is movable on a support board, and wherein the support board has an opening, and the engaging portion engages the engaged portion through the opening.

6. The post-processing device according to claim 5, wherein the restraint member rotates around a support shaft and includes a base portion on a side opposite to the engaging portion with respect to the support shaft, wherein the covering part has an inner face on which the restraint release mechanism is provided, and wherein the restraint release mechanism is a protrusion that pushes the base portion so that the engaging portion rotates in a direction away from the engaged portion when the covering part is closed.

7. The post-processing device according to claim 6, wherein the base portion is disposed closer than the stapler to the covering part.

8. The post-processing device according to claim 4, wherein the restraint member rotates around a support shaft and includes a base portion on a side opposite to the engaging portion with respect to the support shaft, wherein the covering part has an inner face on which the restraint release mechanism is provided, and wherein the restraint release mechanism is a protrusion that pushes the base portion so that the engaging portion rotates in a direction away from the engaged portion when the covering part is closed.

9. The post-processing device according to claim 8, wherein the base portion is disposed closer than the stapler to the covering part.

10. The post-processing device according to claim 3, wherein the restraint member rotates around a support shaft and includes a base portion on a side opposite to the engaging portion with respect to the support shaft, wherein the covering part has an inner face on which the restraint release mechanism is provided, and wherein the restraint release mechanism is a protrusion that pushes the base portion so that the engaging portion rotates in a direction away from the engaged portion when the covering part is closed.

11. The post-processing device according to claim 10, wherein the base portion is disposed closer than the stapler to the covering part.

12. The post-processing device according to claim 2, wherein the engaging portion engages the engaged portion by protruding from a lower side in a vertical direction.

13. The post-processing device according to claim 12, wherein the stapler is movable on a support board, and wherein the support board has an opening, and the engaging portion engages the engaged portion through the opening.

14. The post-processing device according to claim 13, wherein the restraint member rotates around a support shaft and includes a base portion on a side opposite to the engaging portion with respect to the support shaft, wherein the covering part has an inner face on which the restraint release mechanism is provided, and wherein the restraint release mechanism is a protrusion that pushes the base portion so that the engaging portion rotates in a direction away from the engaged portion when the covering part is closed.

15. The post-processing device according to claim 14, wherein the base portion is disposed closer than the stapler to the covering part.

16. The post-processing device according to claim 12, wherein the restraint member rotates around a support shaft and includes a base portion on a side opposite to the engaging portion with respect to the support shaft, wherein the covering part has an inner face on which the restraint release mechanism is provided, and wherein the restraint release mechanism is a protrusion that pushes the base portion so that the engaging portion rotates in a direction away from the engaged portion when the covering part is closed.

17. The post-processing device according to claim 16, wherein the base portion is disposed closer than the stapler to the covering part.

18. The post-processing device according to claim 2, wherein the restraint member rotates around a support shaft and includes a base portion on a side opposite to the engaging portion with respect to the support shaft, wherein the covering part has an inner face on which the restraint release mechanism is provided, and wherein the restraint release mechanism is a protrusion that pushes the base portion so that the engaging portion rotates in a direction away from the engaged portion when the covering part is closed.

19. The post-processing device according to claim 18, wherein the base portion is disposed closer than the stapler to the covering part.

20. An image forming apparatus comprising:

an image forming apparatus body that forms an image on a recording medium; and the post-processing device according to claim 1, the stapler being configured to use a staple to bind a plurality of the recording mediums that are discharged from the image forming apparatus body.

* * * * *